United States Patent [19]

Sanford, Jr.

[11] 4,221,173

[45] Sep. 9, 1980

[54] CONVERTIBLE FURNITURE

[75] Inventor: Carl C. Sanford, Jr., Rockville, Md.

[73] Assignee: Victoria Miller, Bethesda, Md.

[21] Appl. No.: 937,782

[22] Filed: Aug. 29, 1978

[51] Int. Cl.[2] ..... A47B 3/00

[52] U.S. Cl. ..... 108/113; 108/14; 108/77

[58] Field of Search ..... 108/11, 14, 18, 77, 108/112, 113; 190/12 A, 14, 15 R

[56] References Cited

U.S. PATENT DOCUMENTS

| | | | |
|---|---|---|---|
| 1,334,792 | 3/1920 | Rankin | 108/14 X |
| 1,485,479 | 3/1924 | Bury et al. | 190/12 A |
| 2,110,068 | 3/1938 | Kawhlski | 108/11 X |

*Primary Examiner*—James C. Mitchell

*Attorney, Agent, or Firm*—Bacon & Thomas

[57] ABSTRACT

A convertible article of furniture wherein successive sections each comprise a table top panel and a leg panel. The table top panels are hingedly connected in a row to form an elongated table when the article is in full open position but each table top panel is adapted to fold downwardly with its associated leg panel moving under the next adjacent panel to form successively smaller units.

7 Claims, 5 Drawing Figures

CONVERTIBLE FURNITURE

This invention relates generally to an article of convertible furniture, and more specifically to a desk, table, display counter or the like that can be folded up through a succession of stages to form smaller tables, desks, or the like, and can finally assume a compact, fully closed position.

It is a primary object of this invention to provide an article of convertible furniture that can be conveniently folded from one position to another, thereby enabling its use for a wide variety of purposes.

It is a further object of the invention to provide an article of convertible furniture that is attractive and functional in all of its intended positions.

Another object of the invention is to provide an article of convertible furniture that is simple in construction, economical in cost, and reliable in use.

Other objects and advantages of the invention will be apparent upon consideration of the following description of the invention when taken in conjunction with the accompanying drawings, in which.

Figure 1:
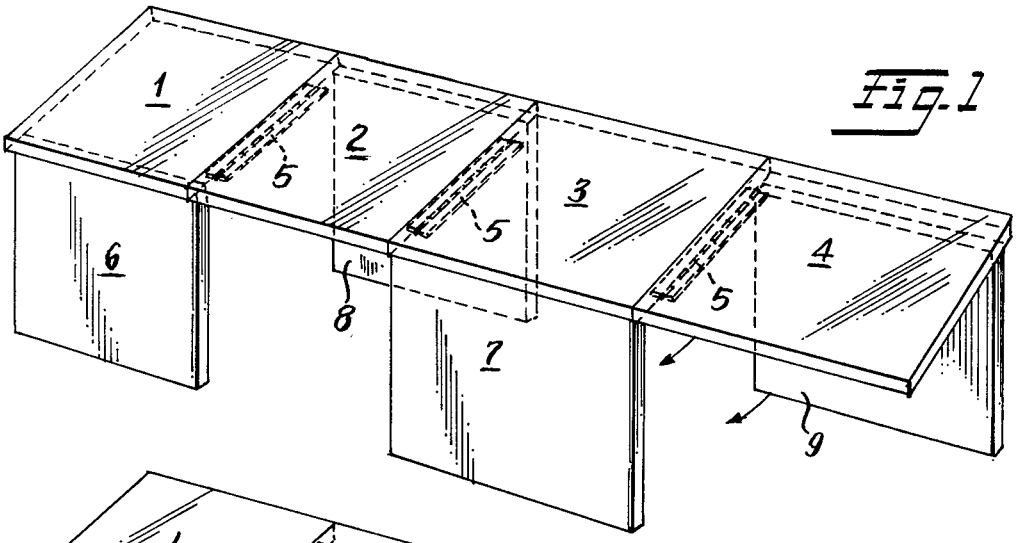
FIG. 1 is a perspective view of one embodiment of the invention, shown in fully open position.

Referring now in more detail to the drawings, the disclosed embodiment comprises a plurality of essentially square panels 1, 2, 3, 4, adapted to serve as tabletop surfaces. These panels 1–4 are arranged in a row, in side-by-side, abutting relation, and are interconnected by piano hinges 5, whereby each panel may be folded in a downward direction with respect to the panel adjacent thereto. The panels may be formed of wood or any other suitable material.

In its fully open position the tabletop assembly is supported in spaced relation above a supporting surface (not shown) by four legs 6, 7, 8, 9. Legs 6–9 may also be essentially square panels of the same material and dimensions as the panels 1–4. While the leg elements are shown as square, it is essential only that they are of sufficient height, in their unfolded position, to support their associated panel at the normal level of the tabletop assembly, but they must not be too wide to rest beneath the normal level of the assembly. Otherwise, they may assume various shapes, sizes or designs.

The leg 6 is mounted in depending relation below panel 1, adjacent one side thereof. Leg 8 is similarly mounted in depending relation below panel 2, but at the opposite side thereof with respect to the position of leg 6. Similarly, leg 7 is mounted below one side of panel 3, generally in alignment with leg 6, and leg 9 is mounted below the opposite side of panel 4, generally in alignment with leg 8. As a result, the legs 6–9 are mounted in staggered relation on both sides of the tabletop assembly, with an open space being left across from each leg.

It should be noted, however, that the legs 7 and 8 are mounted flush with the side edges of panels 2 and 3, respectively, whereas the legs 6 and 9 are spaced inwardly from the side edges of panels 1 and 4, respectively, by a distance corresponding generally to the thickness of the legs.

Figure 2:
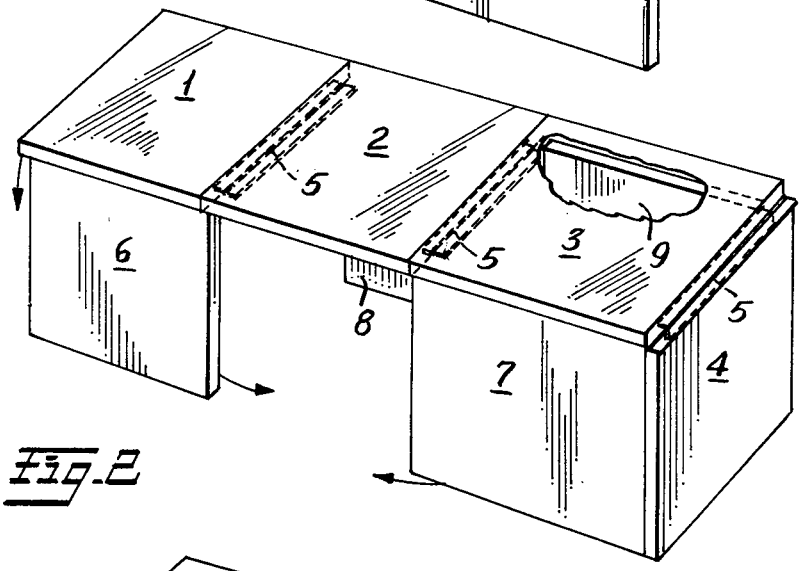
FIG. 2 illustrates the embodiment of FIG. 1 in a second position, partially folded.

In operation, the assembly in the fully open position of FIG. 1 may serve as an enlarged table or a desk for a plurality of students or the like. It may be converted from the position of FIG. 1 to the position of FIG. 2 by raising one end of the assembly to enable panel 4 to be folded downwardly to a vertical position, at which time the leg 9 assumes a position nested below the panel 3, in the space opposite leg 7. In this position, the article can be used as a large desk, with a kneehole space opposite leg 8.

Figure 3:
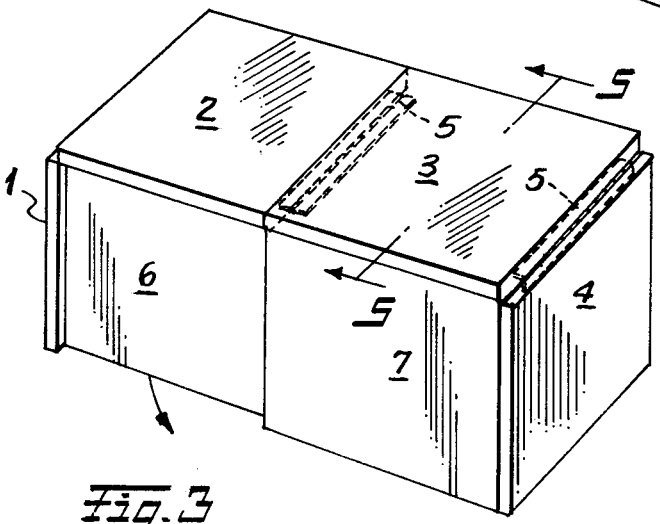
FIG. 3 illustrates the embodiment of FIG. 1 in a third position, further folded.

From this position, the article can be converted to the position of FIG. 3 by again raising one end of the assembly and folding panel 1 downwardly to a vertical position, with leg 6 moving to a nesting position below panel 2, in the space opposite leg 8. In this position, the article can be used as a smaller table or the like.

Figure 5:
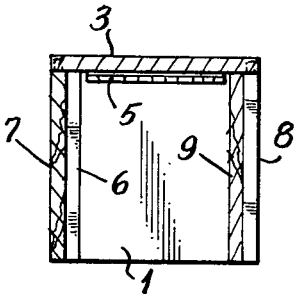
FIG. 5 is a sectional view taken on the line 5—5 of FIG. 3, on a reduced scale.
Figure 4:
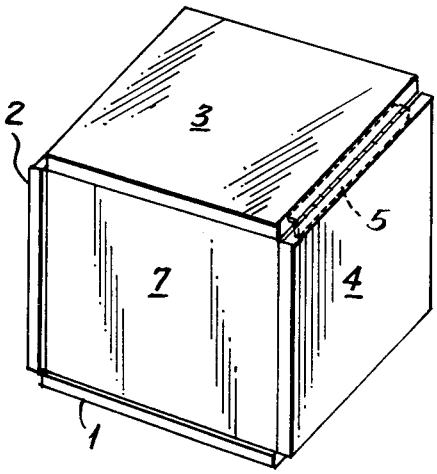
FIG. 4 illustrates the embodiment of FIG. 1 in a fourth position, fully folded.

Finally, the article can be folded into the position of FIG. 4 by folding panel 2 down to a vertical position, with legs 6 and 9 nesting inside legs 7 and 8, respectively, as shown in FIG. 5. In this position the assembly is compactly folded for storage or for use as an end table or the like.

Numerous modifications can be made in the construction, materials, and design of the depicted embodiment, without departing from the spirit of the invention or the scope of the annexed claims.

I claim:

1. An article of convertible furniture comprising a plurality of interconnected panel elements normally disposed in aligned coplanar relation to provide a continuous tabletop surface, and leg means fixedly mounted below each of said panel elements to support said panel elements in spaced relation above a supporting surface, each of said panel elements being adapted to fold downwardly with respect to the next adjacent panel element with its associated leg means being thereby moved to a nesting position below said next adjacent element and spanning the space between the original position of said next adjacent element and said supporting surface.

2. The article of claim 1 wherein each leg has a vertical dimension in the fully open position that is equal to the distance between the tabletop assembly and the supporting surface and wherein each leg has a width no greater than said distance.

3. The article of claim 1 wherein said legs are square panels.

4. The article of claim 3 wherein said panels are square and substantially equal in size to said legs.

5. The article of claim 1 wherein each of said panels is provided with one leg, said legs being mounted adjacent the opposite sides of each successive panel to effect a staggered arrangement with spaces between the legs on either side of the assembly.

6. The article of claim 5 wherein the legs on each side of the assembly are disposed in offset planes to permit nesting with respect to each other when moved to a folded position.

7. The article of claim 6 wherein four interconnected panel elements are provided, whereby the assembly in its fully folded position is closed on all six sides by said panel elements and said leg means.

* * * * *